United States Patent [19]

Mairy

[11] 4,313,975

[45] Feb. 2, 1982

[54] METHOD OF IMPROVING OPERATION OF CONTINUOUS CASTING NOZZLE

[75] Inventor: Bernard Mairy, Sclayn-Andenne, Belgium

[73] Assignee: Centre de Recherches Metallurgiques-Centrum voor Research in de Metallurgie, Brussels, Belgium

[21] Appl. No.: 225,711

[22] Filed: Jan. 16, 1981

[30] Foreign Application Priority Data

Jan. 17, 1980 [LU] Luxembourg ..... 82093
Feb. 21, 1980 [BE] Belgium ..... 881852

[51] Int. Cl.[3] ..... B05D 1/10; B05D 5/08; B05D 7/22

[52] U.S. Cl. ..... 427/236; 427/34; 427/230; 427/423

[58] Field of Search ..... 427/34, 230, 423, 236

[56] References Cited

U.S. PATENT DOCUMENTS 3,304,402 2/1967 Thorpe ..... 118/302 X

*Primary Examiner*—James R. Hoffman
*Attorney, Agent, or Firm*—Holman & Stern

[57] ABSTRACT

The internal surface of a continuous casting nozzle, e.g. for casting steel, is coated with a finely divided material, comprising anti-wetting compounds such as $ZrO_2$, $Cr_2O_3$, and boron nitride, constituting a coating which inhibits the deposition of non-metallic inclusions tending to block the nozzle.

11 Claims, No Drawings

METHOD OF IMPROVING OPERATION OF CONTINUOUS CASTING NOZZLE

FIELD OF THE INVENTION

The present invention relates to a method of improving the operation of nozzles for the continuous casting of metals, in particular steel.

BACKGROUND OF THE INVENTION

In the continuous casting of metals, such as steel, the processed metal is cast in a suitable container, called a division tundish, from which it pours in a continuous manner into a casting mould by means of a particular discharge tube known as a nozzle. When steel is cast with relatively large dimensions, the air-steel interface is protected by a powder flux and, under these conditions, during the entire casting operation, the lower end of this nozzle is immersed in the metal contained in the mould.

The following description is based on the case of the nozzle located under the tundish, but this is solely by way of non-limiting example and it should be understood that the invention is concerned with all types of continuous casting nozzles, such as ladle emptying nozzles, division tundish nozzles, or mould nozzles, whether they are in one or a plurality of pieces.

The nozzle is in most cases constituted by a combination of refractory materials whose melting point is particularly high. A nozzle of this type must be resistant not only to the thermal stresses due to the temperature of the cast metal, but also to any chemical action which may result from this, the mechanical effects due to the movements of the metal bath, and erosion by the covering powder generally deposited on the upper surface of the liquid metal in the mould.

In addition, and this is the object of the present invention, it should be protected as far as possible against any blocking, for example by non-metallic inclusions, in particular by alumina or aluminates (in the case of aluminium-killed steel). Blocking of this type is detrimental to the efficiency of the casting operation and impairs the quality of the cast steel, as it requires the deceleration of the withdrawal speed, either for burning off the interior of the nozzle, or for changing the nozzle or the tundish. At worst, casting must be completely stopped.

As far as the inventor is aware, no completely effective method has up to now been proposed to reduce the drawback mentioned above. It is only known to inject inert or neutral gas through the nozzle, which has the effect of retarding its blocking.

The present invention therefore relates to a method of improving the operation of a casting nozzle which has the effect of slowing down the blocking up of the nozzle and making it much less considerable, and therefore reduces or eliminates the drawbacks associated with this.

SUMMARY OF THE INVENTION

The method of the present invention is essentially characterised in that a layer of a finely divided material, designed to prevent the deposition of non-metallic inclusions, is deposited on the internal surface of the refractory constituting the nozzle, this layer thus enabling the metal to pass through the nozzle for an extended period of time without a reduction in section due to the deposition of inclusions.

In practice, the depositing of this layer may be advantageously carried out in several ways, for example by spraying a fluid which either contains the material in suspension or in solution (possibly entirely or partially colloidal), or is constituted by a liquid form of this material (for example a salt of the latter), these operations being followed by a drying or dehydration operation (with or without decomposition) which causes the required material to appear in the desired finely divided form. Spraying may be carried out using dry methods (under hot or cold conditions), followed by possible heating. The technique of impregnation may also be used advantageously, in particular under vacuum.

DESCRIPTION OF PREFERRED EMBODIMENTS

The material to be deposited on the nozzle may be sprayed in the hot or molten state by means of a torch which may be of the plasma type.

The material with which the internal wall of the refractory of the nozzle is covered is mainly constituted by or comprises anti-wetting products, such as $ZrO_2$ and/or $Cr_2O_3$ and/or boron nitride, which are finely divided and possibly linked to carbon. These products may be associated with refractory metals such as for example Mo or Cr, either separately or in order to form a cermet.

In addition, it is also within the scope of the invention to compress these covering materials before inserting them in the nozzles, and to introduce them into the nozzle in the form of sleeves or inserts.

In addition, these anti-wetting products are preferably deposited and treated in such a way as to considerably reduce the roughness of the surface, which facilitates the passage of liquid steel and reduces its tendency to adhere and thus lead to blockages. This property is obtained by subjecting the anti-wetting products to an operation, preferably in situ, consisting of polishing and/or surface heating and/or sintering.

According to a further advantageous variant the coverings for the nozzles inserted in them in the form of sleeves or inserts have a porous structure over all or part of the internal surface of the nozzle, and an inert gas, such as for example argon, is injected into the nozzle through these coverings, via one or several suitable supply conduits, which contributes considerably to decreasing the tendency of the nozzles to block up.

I claim:

1. A method of improving the operation of a continuous casting nozzle, comprising coating the internal surface of the nozzle with a layer of a finely divided material constituting a coating which inhibits the deposition of non-metallic inclusions on the said surface during casting.

2. The method of claim 1, in which the layer is formed by applying a liquid to the said surface and treating the liquid so that the finely divided material is formed.

3. The method of claim 2, in which the liquid is sprayed onto the said surface and then heated.

4. The method of claim 1, in which the coating is carried out by impregnation.

5. The method of claim 4, in which the impregnation is carried out under vacuum.

6. The method of claim 1, in which the material with which the nozzle is to be coated is sprayed onto it in the hot condition by means of a torch.

7. The method of claim 1, in which the finely divided material comprises at least one anti-wetting compound.

8. The method of claim 1, in which the finely divided material comprises at least one compound selected from the group consisting of $ZrO_2$, $Cr_2O_3$, and boron nitride.

9. The method of claim 1, in which the finely divided material is a cermet.

10. The method of claim 1, in which the finely divided material is firstly compressed before being introduced into the nozzle in the form of an insert.

11. The method of claim 1, in which the coating has a porous structure, and an inert gas is injected into the nozzle through the coating.

* * * * *